United States Patent [19]

Dahlby

[11] Patent Number: 4,752,009

[45] Date of Patent: Jun. 21, 1988

[54] APPARATUS FOR SEGREGATING PARTS

[75] Inventor: Larry C. Dahlby, Racine, Wis.

[73] Assignee: S. C. Johnson & Son, Inc., Racine, Wis.

[21] Appl. No.: 13,085

[22] Filed: Feb. 10, 1987

Related U.S. Application Data

[63] Continuation-in-part of Ser. No. 821,661, Jan. 23, 1986, Pat. No. 4,676,380.

[51] Int. Cl.[4] ..... B07C 5/04; B07C 5/36

[52] U.S. Cl. ..... 209/616; 209/628; 209/671; 425/DIG. 51

[58] Field of Search ..... 209/606, 616, 615, 625, 209/628, 671, 667, 607; 425/215–217, DIG. 51

[56] References Cited

U.S. PATENT DOCUMENTS

| | | | |
|---|---|---|---|
| 781,616 | 1/1905 | Owens et al. | 209/607 |
| 1,012,046 | 12/1911 | Anderson | 209/616 |
| 1,474,566 | 11/1923 | Schorer | 209/616 |
| 2,114,263 | 4/1938 | Heaslet | 209/616 |
| 2,710,097 | 6/1955 | Bolles | 209/12 |
| 3,047,149 | 7/1962 | DeKonig | 209/645 |
| 3,651,938 | 3/1972 | Suellentrop, Jr. et al. | 209/663 |
| 3,661,256 | 5/1972 | Hain | 209/645 |
| 3,663,142 | 5/1972 | Cafarelli | 425/217 |
| 3,982,632 | 9/1976 | DeLeon et al. | 209/616 |
| 4,224,350 | 9/1980 | Merck | 209/663 |
| 4,232,506 | 11/1980 | Studer | 209/616 |
| 4,264,012 | 4/1981 | Paradis | 209/664 |
| 4,454,030 | 6/1984 | Young | 209/669 |
| 4,484,684 | 11/1984 | Tetreault | 209/616 |
| 4,541,532 | 9/1985 | Wilson | 209/651 |
| 4,676,380 | 6/1987 | Dahlby | 209/616 |

FOREIGN PATENT DOCUMENTS

| | | | |
|---|---|---|---|
| 679042 | 1/1964 | Canada | 209/616 |

*Primary Examiner*—Robert B. Reeves
*Assistant Examiner*—Donald T. Hajec

[57] ABSTRACT

The present invention is an apparatus for segregating desired parts of predetermined dimension from a jumbled flow of such parts and by-product runners. The apparatus includes structure that defines a path for restricting the jumbled flow to a fixed-flow space along a flow length. The apparatus comprises a three-dimensional array of rotatable pickup fingers substantially filling the fixed-flow space and extending therebeyond. The apparatus further includes a suitable device for continuously moving successive distal portions of the rotatable finger array out of and into the fixed-flow space. The rotatable fingers are spaced apart by distances greater than the predetermined dimensions of the desired parts but less than the longest dimension of the runners, for capturing the runners while allowing the desired parts to pass through the pick-finger array. The apparatus additionally comprises stationary fingers, positioned to intermesh with the rotatable finger array, for causing the desired parts to become separated from the by-product runners. The apparatus further includes additional structure so located and configured as to remove the runners from the rotating fingers during rotation of the finger array and allow the thus-removed runners to be conveyed under the influence of gravity away from the apparatus.

13 Claims, 3 Drawing Sheets

APPARATUS FOR SEGREGATING PARTS

REFERENCE TO RELATED APPLICATION

This application is a continuation-in-part of patent application Ser. No. 821,661, now U.S. Pat. No. 4,676,380, filed Jan. 23, 1986, the benefit of which is claimed for purposes of priority pursuant to 35 U.S.C. §120.

TECHNICAL FIELD OF THE INVENTION

The present invention is directed to the segregation of formed parts of fixed dimension from scrap pieces. More particularly, the present invention is directed to an apparatus for segregating molded production parts from elongated runners which are a by-product of the parts-molding process.

BACKGROUND OF THE INVENTION

In parts-molding operations, there is a need for sorting the output of the molding machine into at least two separate groups—the first group being the desirable molded parts, and the other group being the molding-process by-products (such as those herein referred to as elongated "runners") which are typically recycled.

In typical operation, a molded parts-and-runner product emerges from the molding machine, which automatically cycles in a predetermined manner, wherein some of the desired molded parts are caused to be separated from the elongated runners. Typically, a jumbled mixture—of separated, randomly-oriented, desired molded parts and elongated runners—is moved from the molding machine via conveying apparatus for sorting (i.e., for separation into the two groups mentioned immediately above).

The process of sorting the output of molding machines of this type, in the distant past, was almost always performed by hand. Recently, however, certain devices have been provided, and improvements in methods have been made, to eliminate at least some of the need for manual sorting.

Certain devices and methods for segregation of desirable material from undesirable or unacceptable material are disclosed, for example, in U.S. Pat. Nos. 3,651,938; 3,982,632; 4,264,012; 4,454,030; and 4,484,684.

U.S. Pat Nos. 3,652,938 (to Suellentrop, Jr., et al.) and 3,982,632 (to DeLeon et al.) each discloses a conveyer belt and a cylinder spaced laterally therefrom.

U.S. Pat. No. 4,264,012 (to Paradis) discloses a pair of spaced-apart baffles, and an axially-rotatable coil sandwiched therebetween.

U.S. Pat. No. 4,454,030 (to Young) discloses a conveyer belt that is fed by a screw-equipped conveyer.

U.S. Pat. No. 4,484,684 (to Tetreault) discloses an apparatus comprising a conveyer, a parts separator that is fed by the conveyer, an auger-comminuting device, and a chute. The auger-comminuting device and the chute are spaced from each other and from the parts separator which feeds them both.

Experience has shown that conventional devices, such as those briefly mentioned immediately above, possess certain deficiencies and accordingly present certain problems. For example, some prior-art devices have shown themselves to be less than thorough in their segregation of parts from runners.

In particular, it has been observed, when utilizing such conventional devices or apparatus, that runners (i.e. the undesirable by-products) too frequently fall between members or components that are purportedly intended or designed to catch or hold such runners, with the result being that an unacceptable percentage of the runners tends to be carried along with the separated, desired parts, which is of course undesirable. Such a result may necessitate subsequent manual separation, or may result in the jamming of subsequent equipment that is utilized, for example, to incorporate the desired part into a final product.

In modern factories that produce plastic molded parts, or that use such plastic parts in subsequent assembly, there is a need for an improved segregating apparatus which substantially eliminates or at least tends to minimize the failure of conventional parts-sorting equipment, for acceptably automatically sorting the desired parts from the scrap of by-product parts or pieces.

SUMMARY OF THE INVENTION

The present invention is an apparatus for segregating desired parts of predetermined dimension from a jumbled flow of such parts and by-product runners. The apparatus includes structure that defines a path for restricting the jumbled flow to a fixed-flow space along a preselected flow length (i.e., in a preselected flow direction). The apparatus comprises a three-dimensional array of rotatable pickup fingers substantially filling the fixed-flow space and extending therebeyond. The apparatus includes a suitable device for continuously moving successive portions of the rotatable pickup-finger array out of and into the fixed-flow space. The rotatable fingers are spaced apart by distances greater than the predetermined dimensions of the desired parts, but less than the longest dimension of the runners, for capturing the runners while allowing the desired parts to pass through the pickup-finger array. The apparatus further comprises stationary fingers positioned to intermesh with the rotatable three-dimensional pickup-finger array, for causing the desired parts to become separated from the by-product runners. The apparatus still further includes additional structure so located and configured as to not only remove the runners from the rotating fingers during movement of the three-dimensional rotating-finger array but also to allow the thus-removed runners to be conveyed under the influence of gravity away from the apparatus.

BRIEF DESCRIPTION OF THE DRAWINGS

Throughout the drawings, like reference numerals refer to like parts.

DETAILED DESCRIPTION OF PREFERRED EMBODIMENTS

Figure 5:
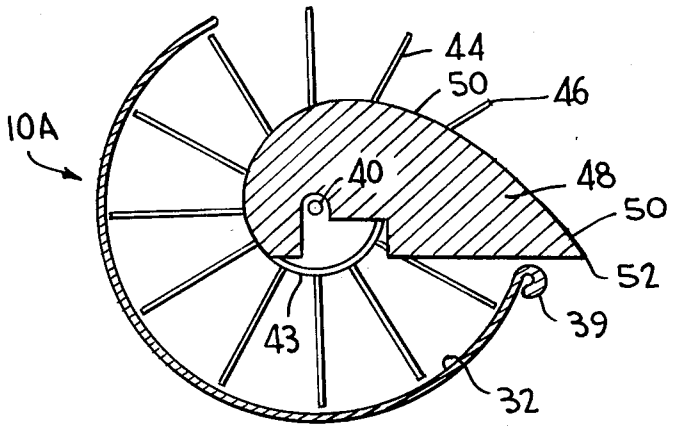
FIG. 5 is a projected, sectional view taken from the plane 5—5 in FIG. 3.
Figure 4:
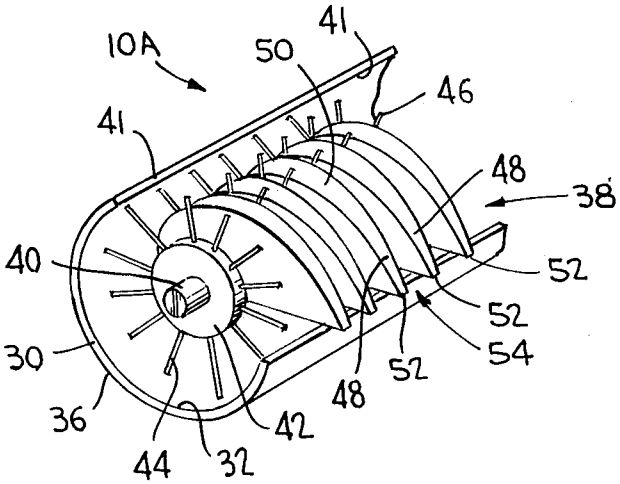
FIG. 4 is a partially fragmented perspective view, also taken from the down-stream end of the apparatus shown in FIGS. 2–3 and on a reduced scale relative thereto.

While the present invention is susceptible to embodiment in various forms, there is shown in the drawings and hereinafter described in detail a number of presently preferred embodiments of the invention, with the understanding that the present disclosure is to be considered as an exemplification of the invention without limitation to the specific embodiments illustrated.

The figures illustrate or present a segregator device or apparatus, in accordance with this invention, for separating parts of predetermined dimension from a jumbled flow of such parts and elongated runners. The parts-segregator device or apparatus 10 (FIG. 1) is particularly useful in separating desired molded plastic parts from a jumbled flow of such parts, which jumbled flow includes not only the desired plastic parts but also the elongated plastic runners to which the desired parts were previously joined (i.e., when formed in the molding process).

Figure 1:
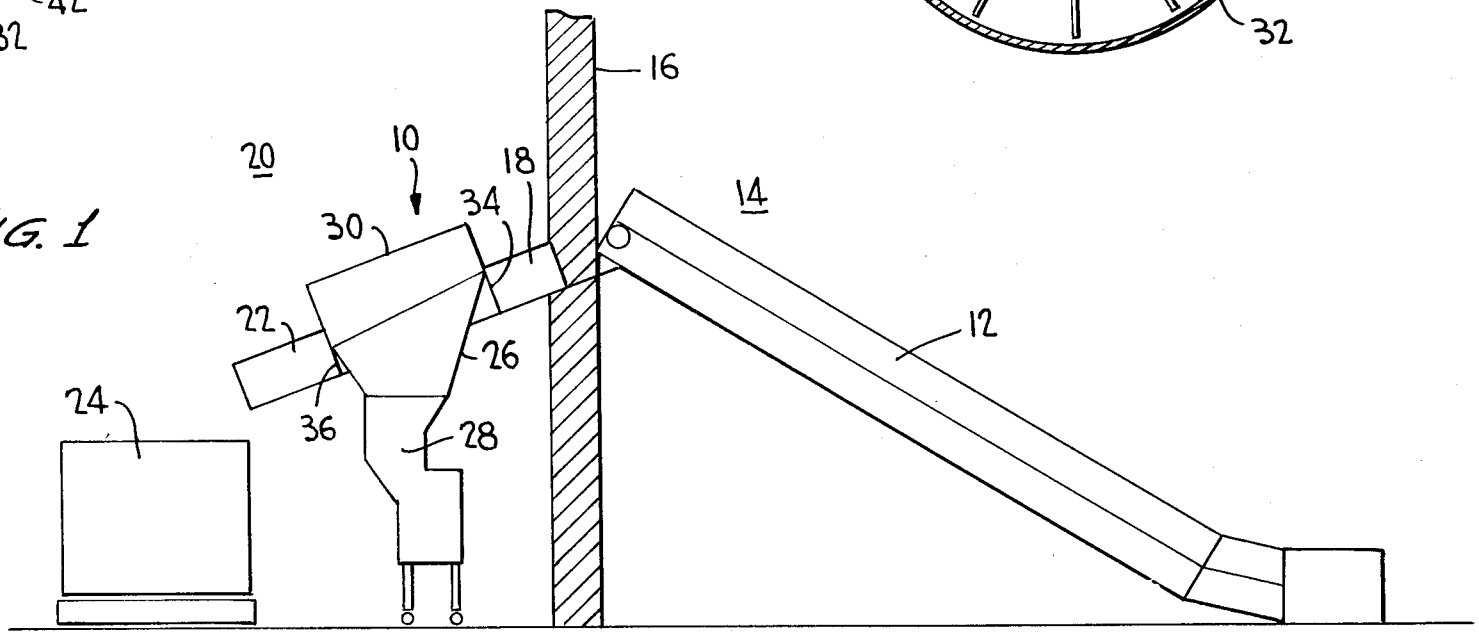
FIG. 1 is a schematic side elevation, illustrating one preferred use of the apparatus of the present invention in combination with a plastic-molding process or operation.

FIG. 1 accordingly presents the typical, preferred location and orientation of segregator device or apparatus 10 as it would be placed in a modern, plastic-parts production facility. An upwardly-directed, inclined conveyer 12 carries the jumbled plastic parts and elongated runners, from molding equipment (not shown) in molding room 14, to an opening (also not shown) in wall 16 through which opening the plastic parts and elongated runners are dropped, by operation of conveyer 12, and thereafter are fed into a lead chute 18 (which is in a sorting and storage room 20). Lead chute 18 guides the jumbled flow of molded parts and elongated runners, under the influence of gravity, into segregator apparatus 10.

Briefly describing passage through the invention (FIG. 1), the present apparatus 10 segregates the desired, molded parts from the undesired, elongated runners (in a manner which will be described in greater detail hereinbelow). the desired molded parts slide through segregator apparatus 10, still under the influence of gravity, and pass downwardly through exit chute 22 and from there into storage container 24. The undesired, elongted runners are lifted out of the jumbled flow of parts by the co-action of the several component parts (and structure) of the segregator apparatus 10. From segregator apparatus 10, the runners are caused to move—by operation of the segregator apparatus 10—laterally into a side chute 26. The runners pass through the side chute 26, under the influence of gravity, and upon exiting side chute 26, drop into a grinder 28 which grinds the runners in preparation for subsequent re-use (e.g. for recycling the runners in the above-mentioned molded plastic parts-processing operation).

Figure 2:
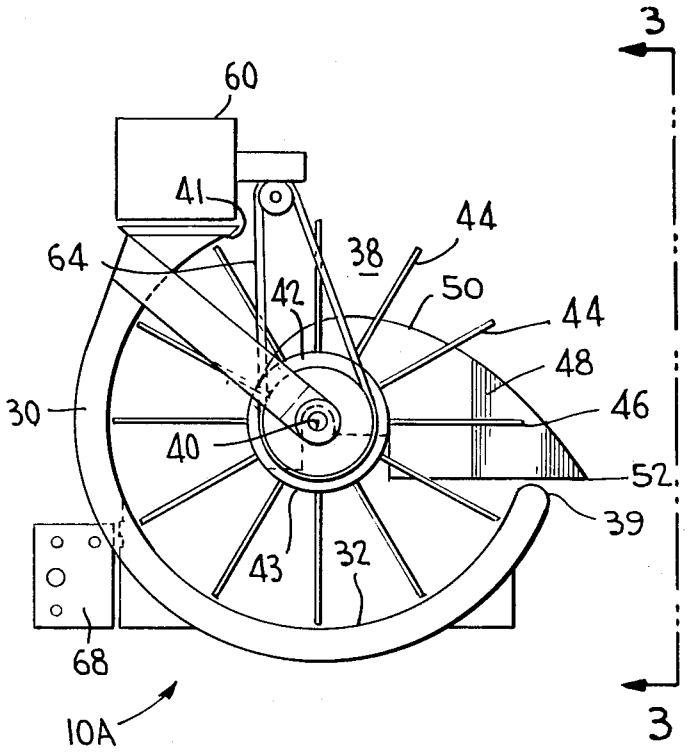
FIG. 2 is a side elevation (also sometimes called a "projected" or frontal view) of one preferred embodiment of the segregating apparatus (in accordance with the present invention), taken from the down-stream end of the apparatus, on an enlarged scale relative to FIG. 1.

A first embodiment of the present segregator apparatus 10A is briefly described as follows. The segregator apparatus 10A includes a main chute 30 having a cylindrical inner surface 32 (FIG. 2). Main chute 30 has a lead end 34 (FIGS. 1 and 3) into which the jumbled plastic parts and elongated runners flow. Main chute 30 also has an exit end 36 (FIGS. 1 and 3) from which the plastic parts alone exit the present parts-segregator apparatus or device.

Main chute 30 is preferably tilted relative to the horizontal, as shown in FIG. 1, so that gravity can be used to cause the jumbled flow of molded, desired plastic parts to pass through the main chute 30 of the segregator apparatus and into storage container 24. The segregator apparatus, in particular, is specifically designed to segregate the desired parts (of predetermined dimension) from the jumbled flow of such parts and runners, wherein the runners have at least one dimension that is greater than the desired parts dimension. To assist in such gravity flow, the cylindrical inner surface 32 of the first embodiment of the segregator apparatus 10A (i.e., shown in FIGS. 2–5) is preferably quite smooth. While the amount or degree of tilt should be sufficient for reliable flow through main chute 30, the amount or degree of tilt should not be too steep relative to the horizontal, because too great a tilt can slightly increase the chance of unintended passage of a runner all the way through chute 30, which is undesirable. A tilt of about 20° from the horizontal has been found to be acceptable in most instances.

Main chute 30 has an opening 38 (FIGS. 2 and 4) along its upper margin, and along a portion of one side thereof, which opening 38 is used for removal of the elongated runners after they are separated from the desired molded parts. Opening 38 extends from lateral edge 39 to upper edge 41 (FIG. 2), both of which edges 39 and 41 extend substantially parallel to the axis defined by shaft 40 (FIGS. 2–5) for the full length of main chute 30.

Figure 3:
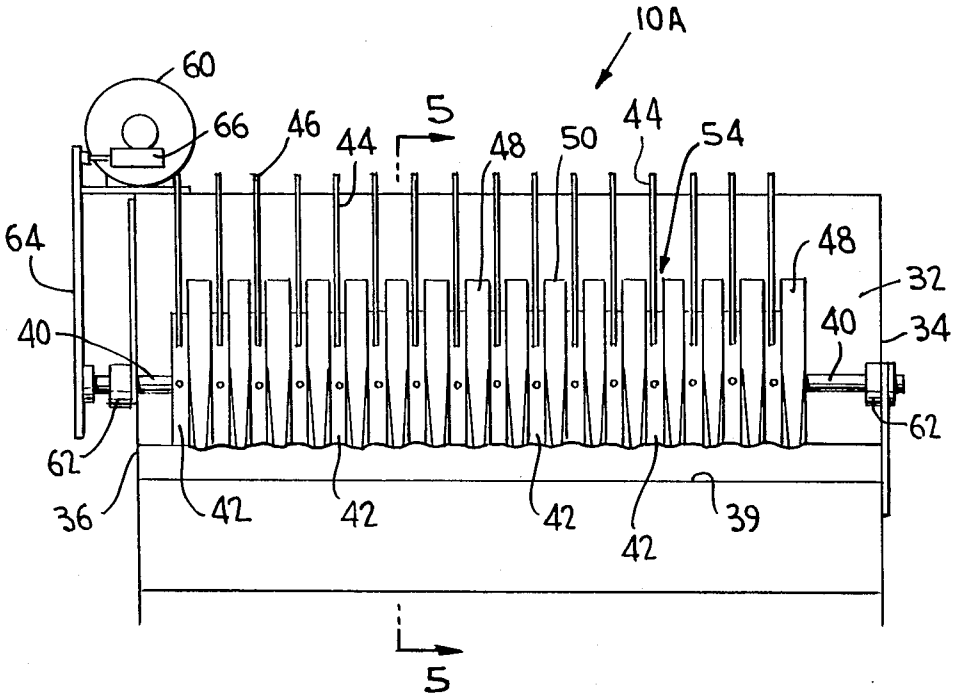
FIG. 3 is a side view taken from the plane 3—3 in FIG. 2.

Shaft 40, supported by bearing means 62 (FIG. 3), is located within the space defined by main chute 30, and is substantially concentric with respect to cylindrical inner surface 32 (FIG. 2). Shaft 40, moreover, extends substantially along the full length of main chute 30 (FIG. 3). Shaft 40 is caused to rotate in the bearing means 62 by operation of a suitable drive means such as the conventional drive motor 60. Drive motor 60, in turn, is operatively connected to shaft 40 by a suitable gear means such as the conventional gear box 66 and chain-drive means 64 (all shown in FIG. 3).

Removably fixed to shaft 40, at axial positions that are spaced preferably substantially equally along shaft 40, are a number of hubs 42 (FIGS. 2 and 3) that rotate along with shaft 40. Each of the hubs 42 has a circumferential surface 43 (FIG. 2); and a number of rod-like fingers 44, of suitable length and resiliency, are removably secured to hubs 42 along each one of the circumferential surfaces 43 (FIGS. 2 and 3). On each hub 42, the fingers 44 are preferably equally spaced along the circumferential surface 43 (FIG. 2). Moreover, the fingers 44 preferably all have the same length, and all preferably extend along radii centered on their respective hubs 42 and on shaft 40.

The length of the rotating fingers 44 preferably is chosen such that the distal ends 46 thereof are spaced closely adjacent to the inner surface 32 of main chute 30 (FIGS. 2 and 5). Because the rotating fingers 44 are preferably resilient, and therefore somewhat stiff yet relatively flexible, the length of the fingers 44 can be such that the distal ends 46 may even be in contact with the inner surface 32 during at least a portion of the rotation of the fingers 44 relative to the inner surface 32.

The fingers 44, together with the shaft 40 and the hubs 42, form a three-dimensional array of rotating pickup-finger means, wherein the fingers 44 are positioned to substantially fill the confined space, in main chute 30, that is defined by the cylindrical inner surface 32. The three-dimensional pickup-finger array is caused to rotate in bearing means 62 by drive motor 60, with the distal ends 46 of the fingers 44 moving repeatedly into and out of the confined space (within main chute 30). Such rotation of the fingers 44 relative to the main chute 30 can be in a clockwise direction (i.e., as viewed from FIGS. 2 and 5) or in a counterclockwise direction (not shown), whichever is desired. When operating in the illustrated clockwise direction, the distal ends 46 of the rotating fingers 44 leaving the confined space in main chute 30 first pass upper edge 41, and thereafter pass through stripper elements 48 (described in greater detail below), and then finally pass lateral edge 39 before once again entering the confined space in main chute 30.

The rotational speed of the fingers 44 will depend, to some extent, upon the total number of fingers 44, the diameter and length of the main chute 30, the circumferential spacing of the fingers 44 about individual hubs 42, and the axial spacing of the fingers 44 along the length of shaft 40, all relative to the predetermined dimensions of the desired parts and by-product runners. For example, when the main chute 30 is about 2 feet in diameter, the rotational speed of the fingers 44 is generally about 1 to about 4 revolutions per minutes (RPMs).

The rotating fingers 44 of the three-dimensional array are spaced apart, at their distal ends 46 and at portions near such distal ends 46, by distances that are greater than the dimensions of the desired plastic parts that are to be separated from the jumbled flow (of plastic parts and elongated runners). Such spacing of rotating fingers 44, however, is preferably less than the length of the longest dimension of the elongated runners. In the parts-molding operation (briefly mentioned and discussed hereinabove), parts-and-runners molds can usually be readily designed to cause desired molded parts and by-product runners to have suitable dimensions to enable the present segregator apparatus to achieve the parts-separation result discussed herein.

In a preferred arrangement of rotating fingers 44 (FIG. 4), alternating hubs 42 have the respective rotating fingers 44 mounted thereon in a manner such that the rotating fingers 44 on any one hub 42 are radially aligned so as to be disposed between the fingers 44 on its nearest hub neighbors. This so-called "offset" arrangement has been observed to substantially eliminate any unintended passage of a major portion of elongated runners through main chute 30 for many of the different-sized runners currently being segregated by the present segregator apparatus illustrated in FIGS. 2–5.

By virtue of such spacing of rotating fingers 44, the desired plastic parts that slide through main chute 30, while they might engage the rotating fingers 44 during such movement, pass through the array of fingers 44, under the influence of gravity, and exit main chute 30 at its exit end 36. In contradistinction, the elongated runners in main chute 30 are captured, by the rotating fingers 44, and thereafter are moved (by the rotating fingers 44), along the cylindrical inner surface 32, in a direction that is generally transverse to the direction of movement of the desired plastic parts, and finally, are lifted by the rotating fingers 44, for lateral removal from main chute 30, again utilizing the force of gravity.

Such removal of the runners is accomplished by the interaction of the rotating array of pickup fingers 44 with an aligned array of stripper elements 48 (FIGS. 2 and 3), which are sandwiched between (i.e., disposed so as to intermesh with) the several pluralities of rotatable fingers 44, as shown in FIG. 3. Slots or lateral spaces 54 (FIG. 4), which are perpendicular to shaft 40 and aligned with the hubs 42, are defined between adjacent pairs of stripper elements 48. The number, positioning and orientation of the several slots 54 is such that all of the rotating fingers 44 of each hub 42 turn or rotate within a corresponding one of the slots 54, as shown in FIG. 3.

Furthermore, as shown in FIG. 5, each stripper element 48 is supported at one end portion thereof by shaft 40 and at the opposite end portion thereof by lateral edge 39 (of main chute lateral opening 38). The stripper elements 48 are preferably equally spaced longitudinally along shaft 40, intermeshing with hubs 42, as shown in FIG. 3.

The stripper elements 48, still further, preferably have upwardly-facing arcuate surfaces 50 of convex curvature (FIGS. 3–5), which surfaces are in alignment so that when viewed along the projected view (FIGS. 2 and 5), the parts-stripper upper surfaces 50, taken together, are seen to form a runner reception surface onto which the elongated runners are deposited by the rotating action of the three-dimensional array of pickup fingers 44 and from which such runners slide laterally and downwardly into side chute 26 and ultimately into grinder 28.

The above-described runner-reception surface that is formed by the upper surfaces 50 of stripper elements 48 extends from a position within the three-dimensional pickup-finger array to a lateral position outside such array, as shown in FIG. 5. Such a runner-reception surface has a terminal edge 52 (as indicated in FIGS. 2 and 5) which is radially outwardly spaced from the terminal boundary of the array of rotating fingers 44 relative to shaft 40.

The above-described runner-reception surface (that is formed by the upper surfaces 50) and the arcs that are scribed by the movement of the distal ends 46 of the rotating fingers 44 intersect at a predetermined location on the downward slope of the runner-reception surface (FIGS. 2 and 5) that is disposed generally downwardly so that the runners can slide, on the surfaces 50 and under the influence of gravity, as described above. In particular, it is at this point of intersection that the elongated runners, which have been removed from the jumbled flow of by-product runners and plastic parts, are released from the three-dimensional array of rotating fingers 44, and thereby caused by the downward slope of the runner reception surface to slide into side chute 26 (FIG. 1). The degree to which the upper surface 50 tilts downwardly, from this point of intersection, is not critical but will depend, to a large extent, upon the weight of an individual runner and the coefficient of friction of the runner relative to the upper surface 50.

The rotating fingers 44 are preferably made from a suitably-stiff, resilient material such as nylon rods (that are generally circular in cross section), or are preferably made of other commercially-available relatively-rigid yet somewhat flexible, suitably-resilient material. The ability of the rotating fingers 44 to flex, to some extent, tends to prevent substantially any jams (or damage to the segregator apparatus or device) from occurring, as might be caused by unexpected conditions when utilizing conventional separation equipment.

It has also been observed, in a parts-molding operation which generates no by-product runners, that operation of the parts-segregator device disclosed herein, particularly operation of the rotatable pickup-finger array discussed hereinabove, has the tendency of agitating the desired parts that are in main chute 30 and causes the desired parts to tumble and thereby freely flow through main 30 (by this "agitating" effect), virtually eliminating plug-ups in main chute 30, which is of course desirable. This "agitating" effect does away with the typical conventional requirement that requires removing a conventional parts-segregator apparatus from a conventional parts-separation system—much like the parts-separation system that is shown in FIG. 1—when utilizing a "parts" mold that generates no runners.

Variations, of course, can be made to the segregator apparatus or device 10A, described hereinabove, to adapt it for different segregating jobs. For example, changes in the sizes of the parts and the elongated runners might require changes in the arrangement and/or the spacing of the rotating fingers 44, which design changes would be obvious to those skilled in the art. Also, the speed of rotation of the rotating fingers 44 can be adjusted by varying the speed of the drive motor 60, utilizing a suitable speed-control means such as the conventional motor-control means 68, as is shown in FIG. 2.

Figure 6:
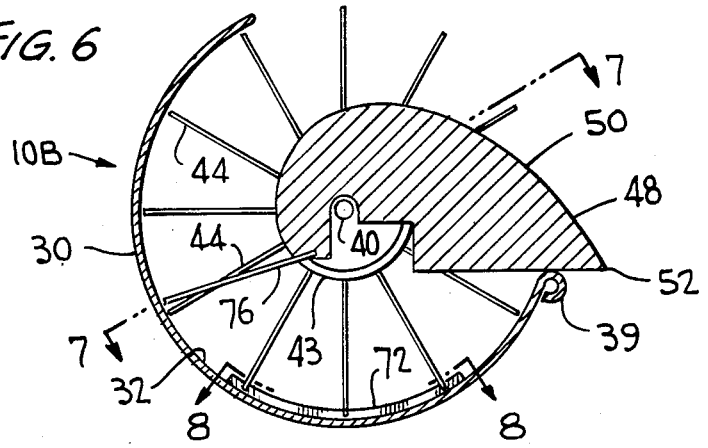
FIG. 6 is a projected, sectional view of yet another embodiment of the apparatus of the present invention.
Figure 7:
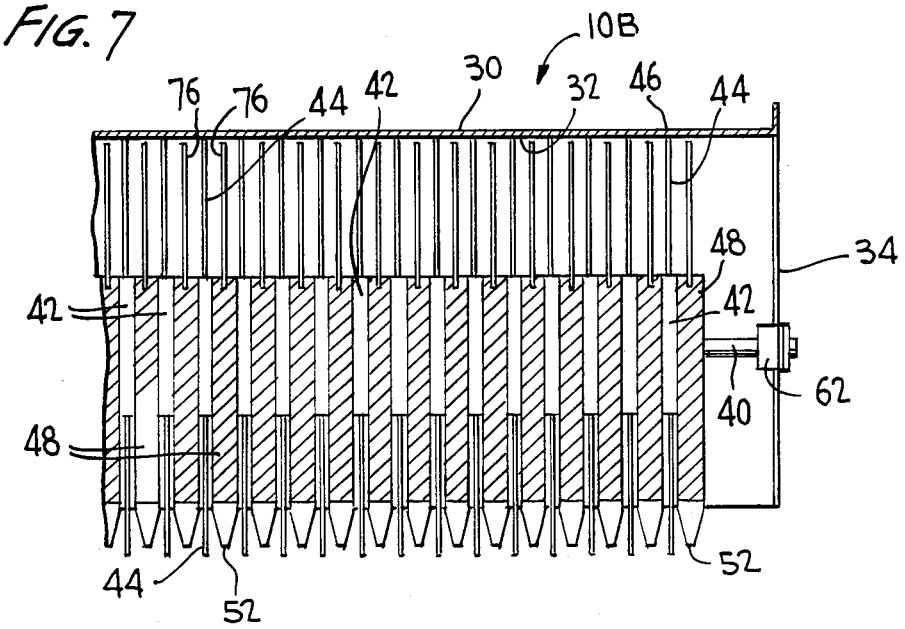
FIG. 7 is a partially-fragmented, plan view taken from the plane 7—7 in FIG. 6.
Figure 8:
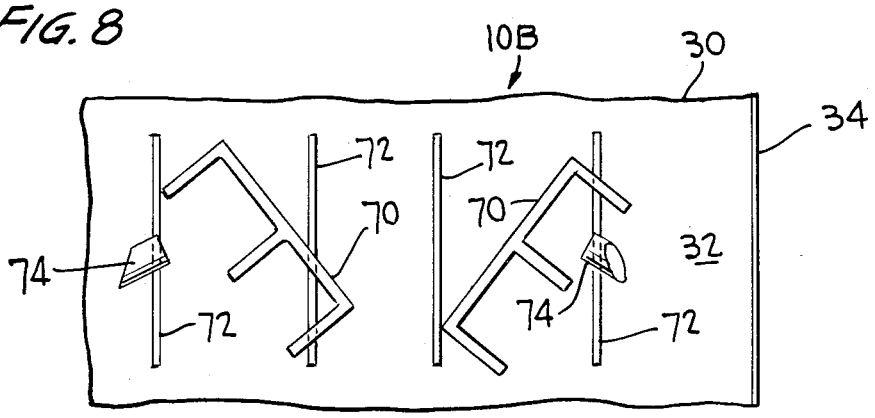
FIG. 8 is a partially-fragmented, plan view taken from the plane 8—8 in FIG. 6.

Referring now to FIGS. 6–8, additional preferred embodiments of the parts-segregator apparatus of the present invention will briefly be described.

In certain situations involving relatively rather thin, yet somewhat elongated, by-product runners 70 (FIG. 8) it is desirable to incorporate into the second embodiment of the segregator apparatus or device 10B a raised projection of suitable dimension, such as the longitudinally spaced-apart ribs 72 shown in FIGS. 6 and 8.

The ribs 72, preferably arcuate (FIG. 6) and configured to conform substantially to the curvature of the cylindrical inner surface 32 of main chute 30, typically possess a height dimension sufficient to substantially block a major portion of the by-product runners 70 from freely sliding axially across the cylindrical inner surface 32 of main chute 30 (FIG. 8) when tilted relative to the horizontal (as shown in FIG. 1), while allowing a substantial portion (i.e., virtually all) of the desired parts 74 to freely slide generally axially across inner surface 32 and into storage container 24 (FIG. 1) as described above. That is, the ribs 72 do not possess so great a height dimension as to block the above-described free-flow of the desired parts 74 longitudinally down the main chute 30, which result is desirable. (The desired parts 74 and by-product runners 70 are not shown in FIGS. 6 and 7, but only in FIG. 8, for reasons of clarity.)

Stating this another way, the molds (not shown) that are used to produce not only the desired parts 74 but also the by-product runners 70 are specifically designed—as is well-known in the art—so that the runner 70 is relatively thinner (at least in one dimension) than the desired parts 74. Thus the ribs 72, preferably removably affixed to the main chute inner surface 32, are suitably dimensioned (relative to the desired part and by-product runner dimensions) to achieve the result discussed above.

Yet, in certain other situations, it is desirable to incorporate into the present segregator apparatus or device a plurality of spaced-apart stationary fingers 76, each stationary finger 76 preferably being fixed to a respective stripper element 48. Together, the stationary fingers 76 intermesh with the rotating fingers 44 (as shown in FIG. 7), for causing a substantial portion (i.e., virtually all) of the by-product runners 70 to separate from the desired parts 74. For example, in certain situations, the desired parts 74 can become entangled with the by-product runners 70.

Or, in certain other situations such as after the parts 74 and runners 70 have been separated, one such desired part 74 may have an opening through which an end portion of another such runner 70 is disposed; and this, at times, has been observed to cause the desired part 74 to be removed from the main chute 30 along with the runner 70 (through operation of the rotating fingers 44, as described above). That is, a part 74 having such an opening can occasionally be observed to be carried along with a runner (such as in the case where a desired part is impaled upon an end portion of a runner), with the result being that the runner together with the desired part (impaled thereon) are removed by operation of the pickup-finger array. In both types of situations, the location and positioning of the stationary fingers 76 relative to the rotating fingers 44 has been observed to positively cause separation of the desired part from the by-product runner.

The stationary fingers 76 are preferably rod-like, are preferably circular in cross section, have distal ends that are spaced preferably relatively closely to the cylindrical inner surface 32 of main chute 30 (as shown in FIG. 7), and are preferably made of the same resilient material as the rotating fingers 44. Moreover, the stationary fingers 76 preferably have a relatively smaller diameter than the rotating fingers 44 so that the stationary fingers 76 flex (before the rotating fingers 44) when opposed, for example, by rotational movement of the rotating fingers 44 about shaft 40.

In operation, this feature of the present invention not only enables the rotating and stationary fingers 44 and 76 to function cooperatively to cause the runners 70 and desired parts 74 to separate, as described above, but also enables the runners 70 to be urged by the rotating fingers 44 through the array of flexing stationary fingers 76, whereupon the rotating-finger array selectively removes the runners 70 from the above-defined confined space (in main chute 30) and thereafter deposits the runners 70 on the upwardly-facing surfaces 50 of the stripper elements 48, substantially in the manner described above.

Further, each stationary fingers 76 is preferably removably press-fitted into a respective stripper element 48, and disposed generally outwardly therefrom, as shown in FIGS. 6 and 7. While the stationary fingers 76 can be disposed radially outward on stripper element 48 relative to shaft 40, the preferred orientation of the stationary fingers 76 is skewed—i.e., away from a "true" radial disposition—in the direction of rotation of the rotating fingers 44 (which is clockwise, when viewed from the down-stream end, as mentioned above) as is shown in FIG. 6.

What has been illustrated and described herein is a novel segregator apparatus. While the segregator apparatus of the present invention has been illustrated and described with reference to several preferred embodiments, the present invention is not limited thereto. On the contrary, alternatives, changes or modifications will become apparent to those skilled in the art upon reading the foregoing description. For example, the segregator apparatus of the present invention can be made utilizing materials and parts which are well-known to those skilled in the art; and, as to the component parts (of the invention) discussed above, appropriate choices would be apparent to those familiar with this disclosure. Accordingly, such alternatives, changes and modifications are to be considered as forming a part of the invention insofar as they fall within the spirit and scope of the appended claims.

I claim:

1. An apparatus for segregating desired parts of predetermined dimension from a jumbled flow of such parts and unwanted pieces, wherein said pieces have at least one dimension that is greater than that of said desired parts, comprising:

restricted-path means for restricting the jumbled flow of such parts and pieces to a fixed-flow space along a flow length;

a three-dimensional array of rotatable pickup fingers substantially filling the fixed-flow space and extending therebeyond, the pickup-finger array comprising several pluralities of fingers disposed in the restricted-path means and rotatable relative thereto, the distance along the flow length between the rotatable fingers being greater than the predetermined dimension of the desired parts;

rotatable pickup finger-movement means for continuously moving successive distal portions of the three-dimensional pickup-finger array out of and into the fixed-flow space;

stationary-finger means, comprising a plurality of stationary fingers so located within the distance between the rotatable pickup fingers along the flow length, for causing separation of said pieces from said desired parts carried by the rotatable pickup fingers or entangled therewith; and stripper means, sandwiched between the several pluralities of rotating fingers and extending from the fixed-flow space, for stripping said pieces from the rotating fingers during movement of the three-dimensional rotating-finger array.

2. The apparatus in accordance with claim 1 wherein each one of the several rotatable pickup finger pluralities is spaced along the flow length from its nearest-neighbor rotatable-finger plurality by a dimension which is less than that of the greatest dimension of said pieces.

3. The apparatus in accordance with claim 1 wherein each one of the several pluralities of rotating fingers, and each one of the pluralities of stationary fingers, are all made of substantially the same resilient material and are circular in cross section, and wherein the stationary finger diameter is less than the rotating finger diameter.

4. The apparatus in accordance with claim 1 wherein the restricted-path means comprises a chute having a substantially cylindrical inside surface with a lateral opening therethrough, and wherein the substantially cylindrical inside surface defines the fixed-flow space.

5. The apparatus in accordance with claim 4 wherein the apparatus is tilted relative to the horizontal and further comprising rib means positioned in the chute, along the flow length, and dimensioned (1) to substantially block a major portion of said pieces from freely sliding along the flow length and through the restricted-path means (2) while allowing a substantial portion of the desired parts to freely slide along the flow length and through the chute.

6. The apparatus in accordance with claim 4 wherein the three-dimensional pickup-finger array comprises:

an elongated, rotatable shaft extending substantially concentrically with the cylindrical inside surface of the chute, and disposed substantially along the flow length; and several rotatable finger-mounting members, removably affixed to and longitudinally spaced along the shaft, for respectively mounting each corresponding one of the several pluralities of rotatable fingers in fixed relation relative to the shaft, and for mounting on each finger-mounting member a respective one of the several pluralities of rotatable fingers.

7. The apparatus in accordance with claim 4 wherein the rotating fingers have distal ends spaced closely adjacent to the cylindrical inner surface.

8. The apparatus in accordance with claim 6 wherein each of the several pluralities of rotatable fingers is mounted on its corresponding finger-mounting member so as to extend in a substantially radial direction outwardly from the shaft.

9. The apparatus in accordance with claim 8 wherein the rotatable fingers are mounted on alternating finger-mounting members along the length of the shaft at radially offset positions relative to the nearest-neighbor finger-mounting members.

10. The apparatus in accordance with claim 6 wherein the stripper means comprises an aligned plurality of stripping elements, each extending from a position spaced above the shaft to a position radially outwardly from an edge margin of the cylindrical inside surface, the stripping elements being spaced generally along the flow length so as to form several slots, each of which slots receives a respective one of the several pluralities of rotatable fingers, each such plurality of rotatable fingers being mounted on a corresponding one of the several finger-mounting members.

11. The apparatus in accordance with claim 10 wherein the stripping elements are aligned so as to present a piece-receiving surface along a projected upper surface of the stripping elements.

12. The apparatus in accordance with claim 11 wherein the piece-receiving surface is inclined toward a position that is radially beyond the edge margin of the cylindrical inside surface, and configured so that the force of gravity will tend to cause pieces which are on the piece-receiving surface to be directed away from the fixed-flow space.

13. The apparatus in accordance with claim 12 wherein a projection of the arcs scribed by rotation of the distal ends of the rotatable fingers intersects the piece-receiving surface at a downwardly inclined portion thereof, so that when said pieces are placed onto the piece-receiving surface by the pickup finger array, such pieces will tend to slide on the piece-receiving surface away from the apparatus through the action of gravity.

* * * * *